US005565168A

United States Patent [19]

Steffens et al.

[11] Patent Number: 5,565,168

[45] Date of Patent: Oct. 15, 1996

[54] ZINC-ALUMINUM CASTING METHOD

[75] Inventors: Thomas Steffens, Frankfurt am Main, Germany; Gary R. Adams, Burlington, Canada

[73] Assignee: Cominco Ltd., Mississauga, Canada

[21] Appl. No.: 243,676

[22] Filed: May 16, 1994

[30] Foreign Application Priority Data

May 19, 1993 [DE] Germany ..... 43 16 755.1

[51] Int. Cl.[6] ..... C22C 18/04

[52] U.S. Cl. ..... 420/516; 148/405; 148/441

[58] Field of Search ..... 420/516, 590; 148/405, 441; 164/459; C22C 18/04

[56] References Cited

FOREIGN PATENT DOCUMENTS 3134899 3/1983 Germany .
60-169536 9/1985 Japan .

*Primary Examiner*—Donald E. Czaja
*Assistant Examiner*—Sean Vincent
*Attorney, Agent, or Firm*—Sprung Horn Kramer & Woods

[57] ABSTRACT

A zinc-aluminum casting alloy composed of 9 to 12% by weight aluminum, 0.6 to 1% by weight copper, 0.02 to 0.05% by weight magnesium, balance high-grade zinc. In order to improve the tribologocal properties of that material for use in sliding surface bearings, the material contains also 0.1 to 1.5% by weight silicon and has been made by continuous casting.

4 Claims, No Drawings

ZINC-ALUMINUM CASTING METHOD

DESCRIPTION

This invention relates to a zinc-aluminum casting alloy for use in sliding surface bearings, which alloy is composed of 9 to 12% by weight aluminum, 0.6 to 1% by weight copper, 0.02 to 0.05% by weight magnesium, balance high-grade zinc.

Zinc-based materials for use in sliding surface bearings are used as substitute materials for copper- or tin-based materials for use in sliding surface bearings and as the most essential additive contain aluminum, which improves the hardening of the material for use in sliding surface bearings and extremely increases the fineness of the grain structure of the material for use in sliding surface bearings. The additive metal next in importance is copper, which is grain-refining and improves the hardening and also increases the resistance to corrosion; that resistance is improved further by an addition of magnesium. The most important zinc alloy for use in sliding surface bearings is composed of 9 to 11% by weight aluminum, 0.6 to 1% by weight copper, 0.02 to 0.05% by weight magnesium, balance high-grade zinc, and is designated by the symbolic representation ZnAl10Cu1 (Schmid E. and R. Weber: Gleitlager, Springer-Verlag Berlin-Göttingen-Heidelberg, 1953, pages 121/122). The above-mentioned ranges of the components of the alloy overlap with those of the zinc alloy having the symbolic representation ZA-12, which is disclosed in Alloy Digest, May 1990, and composed of 10.5 to 11.5% by weight aluminum, 0.5 to 1.2% by weight copper, 0.015 to 0.030% by weight magnesium balance zinc. The following properties are particularly important for the sliding surface bearings which are made from such zinc alloys by a casting in sand molds or permanent molds:

high embeddability high ductility high load-carrying capacity high wear resistance good emergency running properties low wear But the field of application of the zinc-based materials described hereinbefore for use in sliding surface bearing is restricted by their pv factor which is the product of the load p per unit of surface area of the bearing in $N/mm^2$ and the surface speed v of the contacting surface in m/s. For such sliding surface bearings made by sand casting, pv factors up to $4N/mm^2$ m/s are permissible in continuous operation, provided that a surface speed v of 0.3 m/s is not exceeded (company publication: BEARING DESIGN MANUAL, NO-RANDA SALES CORPORATION LTD., TORONTO, JANUARY 1988, page 23).

It is an object of the present invention so to improve the zinc-based material for use in sliding surface bearings which has been described first hereinbefore that the load per unit of surface area of the bearing which is permissible at a given surface speed can be increased, the wear will be reduced and, as a result, the life of the zinc alloy material for use in sliding surface bearings is prolonged.

That object is accomplished in that the material described first hereinbefore for use in sliding surface bearings additionally contains 0.1 to 1.5% by weight silicon and has been made by continuous casting.

The material for use in sliding surface bearings preferably consists of 10.6 to 11.1% by weight aluminum, 0.73 to 0.77% by weight copper, 0.02 to 0.023% by weight magnesium, and 0.15 to 0.6% by weight silicon, balance high-grade zinc.

The continuous casting of the silicon-containing zinc-based material for use in sliding surface bearings results in a homogeneous distribution of fine-grained silicon in the structure of the zinc-aluminum casting alloy and, as a result, in an increase of the resistance to wear of the sliding surface of the sliding surface bearings made from that alloy. The hard inclusions act to eliminate the smoothen and polish uneven contacting surface so that the coefficient of friction is decreased and the permissible load per unit of surface area of the bearing is increased.

The invention will be explained further hereinafter by an illustrative embodiment.

For a comparative test, running tests were conducted with bushings consisting of solid bodies pressed into steel cylinders. The bushings consisted of bushings for radial sliding surface bearings, made by the continuous casting of a material for use in sliding surface bearings, composed of 10.6% by weight aluminum, 0.73% by weight copper, 0.021% by weight magnesium, balance zinc (Zn-GLW I)

bushings for radial sliding surface bearings, made by the sand casting of a material for sliding surface bearings composed of 10.6% aluminum, 0.73% by weight copper, 0.021% by weight magnesium, 0.5% by weight silicon, balance high-grade zinc (Zn-GLW II)

bushings for radial sliding surface bearings, made in accordance with the invention by the continuous casting of a material for use in sliding surface bearings composed of 10.6% aluminum, 0.73% by weight copper, 0.021% by weight magnesium, 0.5% by weight silicon, balance high-grade zinc (Zn-S GLW III)

The bushings had a precision-turned sliding surface and an inside diameter of 24 mm, an outside diameter of 28 mm and a width of 5 mm. The contacting surface of the shaft had been ground to a peak-to-valley height $R_a$ of 0.5 micrometer and consisted of case-hardened steel having the symbolic representation 15Cr (U.S. Standard SAE 5015) and had a HRC hardness number of 60 to 65. The effective bearing clearance was 40 to 50 micrometers. The radial sliding surface bearing was lubricated with an additive-free mineral oil in accordance with the U.S. Standard SAE 40 at a rate of 4 ml/min. The running tests were conducted for 5.5 hours at a surface speed v of 0.2 m/s.

For a determination of the limiting values of the load per unit of surface area. of the bearing, the bushings were subjected to increasing pressures per unit of surface area until an adhesive bond (seizing) occurred between the material of the sliding surface bearing and the shaft material.

The wear of the bushings was measured along five lines before and after each running test with a contact stylus measuring instrument (company publication: PERTHOMETER, Feinprüf GmbH, Göttingen, published Sep. 1, 1989).

During the first test series, the bushings of the materials Zn-GLW I and Zn-GLW III were tested under a load p of $13N/mm^2$ per unit of surface area. The measured values are stated as the averages of the values obtained in three tests.

| Material for use in sliding surface bearings | Wear | Temperature of bearing T (°C.) | Coefficient of friction (μ) |
|---|---|---|---|
| Zn-GLW I | 90 | 60 | 0.14 |
| Zn-GLW III | 25 | 40 | 0.07 |

It is apparent from the table that the bushings made by the continuous casting of the material in accordance with the invention for use in sliding surface bearings (Zn-GLW III)

had a distinctly lower wear and a lower coefficient of friction and, as a result, a lower temperature than the bushings made by the continuous casting of the known silicon-free material for use in sliding surface bearings (Zn-GLW I).

In the second test series the bushings made from the materials Zn-GLW II and Zn-GLW III for use in sliding surface bearings were tested for comparison under a load $p=34N/mm^2$ per unit of surface area of the bearings. The measured values are stated as the averages of the values obtained in three tests.

| Material for use in sliding surface bearings | Temperature of bearing T (°C.) | Coefficient of friction (°C.) |
|---|---|---|
| Zn-GLW II | 90 | 0.085 |
| ZN-GLW III | 80 | 0.075 |

From the measured values obtained it is apparent that the continuous casting of a silicon-containing material having a given composition for use in sliding surface bearings can significantly reduce the coefficient of friction and the temperature of the bearing compared in comparison with a sand-cast material for use in sliding surface bearings. As a result, the continuously cast bushings for use in radial surface bearings have a higher load-carrying capacity.

DE-A-31 34 899 discloses a casting alloy made of high-grade zinc and aluminum and composed of 6 to 30% by weight aluminum, 0.3 to 25% by weight copper, 0.01 to 0.7% by weight magnesium, 0.2 to 7.5% by weight silicon, balance high-grade zinc. But in accordance with the object stated in that publication that alloy is used to avoid a corrosive attack on iron and steel so that the molten alloy can be held in a steel vessel and cast into permanent molds. A use of that alloy for making materials for use in sliding surface bearings had not been contemplated.

Attention is also directed to JP-A-60-169536, which relates to a zinc alloy made by gravity casting in permanent molds and intended for use in sliding elements. The alloy consisted of 3 to 30% by weight aluminum, 0.5 to 5% by weight copper, 0.2 to 5% by weight silicon and 0.0005 to 1% by weight magnesium, balance zinc. The sliding elements allegedly have a high resistance to wear and load. The zinc alloy preferably consists of 10% by weight aluminum, 1% by weight copper, 1% by weight silicon and 0.0005% by weight magnesium. Whereas the ranges of all components of the zinc-based material in accordance with the invention for use in sliding surface bearings are overlapped by the zinc alloy in accordance with JP-A-60-169536, the selection of the narrower partial range in accordance with the invention must be considered new because the improvement of the permissible load per unit of surface area of the bearing and of the coefficient of friction relative to the known zinc-based bearing alloy of the composition described first hereinbefore will be obtained only within the selected ranges, provided that the continuous casting process is employed. But said advantages cannot readily be achieved with a zinc alloy which contains the alloying components in ranges which are as wide as those stated in JP-A-60-169536.

We claim:

1. A process for producing a zinc-aluminum alloy having a homogeneous distribution of fine-grained silicon for use in sliding surface bearings comprising: continously casting a molten alloy consisting of 9 to 12% by weight aluminum, 0.6 to 1% by weight copper, 0.02 to 0.05% by weight magnesium and 0.1 to 1.5% by weight silicon, the balance zinc.

2. A process according to claim 1 comprising continuously casting a molten alloy consisting of 10.6 to 11.1% by weight aluminum, 0.73 to 0.77% by weight copper, 0.02 to 0.023% by weight magnesium and 0.15 to 0.6% by weight silicon, the balance zinc.

3. A sliding surface bearing produced by the process of claim 1.

4. A sliding surface bearing produced by the process of claim 2.

* * * * *